United States Patent [19]

Franklin

[11] 3,964,555

[45] June 22, 1976

[54] APPARATUS FOR OBTAINING EARTH CORES

[76] Inventor: Wesley D. Franklin, 1005 D Pleasant Oaks Road, Baltimore, Md. 21234

[22] Filed: Nov. 14, 1975

[21] Appl. No.: 632,083

[52] U.S. Cl. ..... 175/44; 175/106; 175/230; 175/255; 175/320

[51] Int. Cl.[2] ..... E21B 9/20

[58] Field of Search ..... 175/44, 58, 99, 113, 175/79, 81, 230, 234, 82, 83, 319, 244, 320, 325, 94, 248, 106, 249, 20, 61, 173, 202, 203, 218, 236, 255

[56] References Cited

UNITED STATES PATENTS

| | | | |
|---|---|---|---|
| 1,484,065 | 2/1924 | Gould | 175/99 X |
| 1,773,915 | 8/1930 | Lydon | 175/239 X |
| 2,313,576 | 3/1943 | Phillips et al. | 175/44 |
| 2,324,682 | 7/1943 | De Long | 175/81 |
| 2,859,938 | 11/1958 | Boucher | 175/44 |
| 3,225,843 | 12/1965 | Ortloff et al. | 175/230 X |
| 3,241,623 | 3/1966 | Martinez | 175/44 |

*Primary Examiner*—Ernest R. Purser
*Assistant Examiner*—Richard E. Favreau
*Attorney, Agent, or Firm*—J. Wesley Everett

[57] ABSTRACT

An apparatus for obtaining earth samples of soil or rock from the bottom of holes previously drilled in the earth, the apparatus having an outer and inner non-rotatable casing and a rotatable intermediate casing wherein the intermediate casing is provided with a cutter head fixed to the outer end thereof, including a rotatable hollow shaft adapted to rotate the intermediate casing through a reduction gear train and to supply water or other drill fluid under predetermined pressures to the apparatus, the outer casing having expandable earth engaging arms operatable by the water or fluid pressure received from the hollow shaft for engaging the side wall of the previously bored hole formed in the earth wherein the earth engaging arms will prevent rotation of the outer and inner casing while the hollow shaft is rotating the intermediate casing, and means carried within the outer casing for supporting the gear train, including means incorporated within the apparatus for marking the azimuth of the core, and means for retrieving the oriented core within the inner casing while the apparatus is being removed from the bored hole.

10 Claims, 7 Drawing Figures

APPARATUS FOR OBTAINING EARTH CORES

The present invention relates to a new and novel apparatus for obtaining samples from the bottom of holes bored into the earth, which samples are generally referred to as cores.

One object of the invention is to provide an apparatus that will capture and retain a more perfect earth sample.

Another object of the invention is to provide a simple and more efficient method for obtaining the sample.

A further object of the invention is to provide new and novel means for anchoring one or more of the elements of the apparatus to the side wall of the bored hole to prevent their reaction.

Still another object of this invention is to obtain earth cores marked with the same azimuth at which the core material was located before removal from the earth.

Still a further object of the invention is a system which will prevent core blockage.

While several objects of the invention have been set forth, other objects, uses and advantages will become more apparent as the nature of the invention is more fully disclosed in the following description with reference to the accompanying drawings.

The apparatus includes in particular three separate telescoped cylindrical casings, that is, an outer casing 2, an inner casing 4, and an intermediate casing 6. All casings are spaced apart allowing a narrow channel space between the walls of each of the casings and means are provided for supporting the casings in the form of a hollow rotatable shaft 22.

Figure 1A:
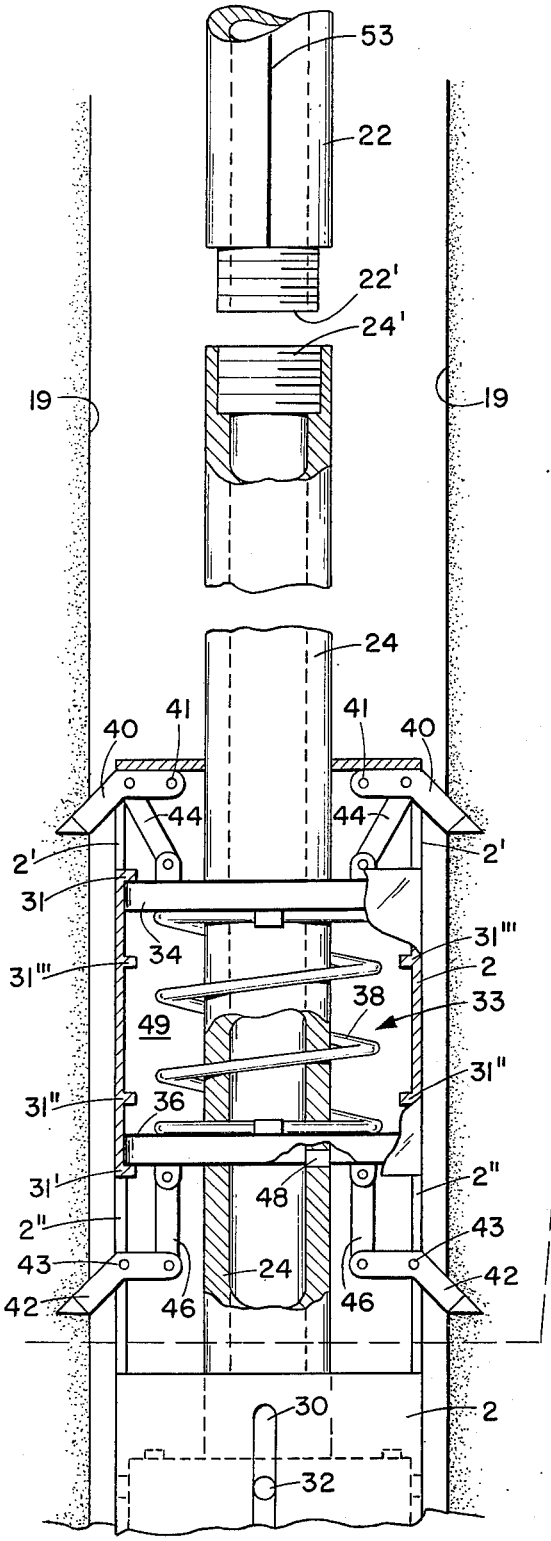
FIG. 1A is a sectional view of the upper portion of the apparatus.

The outer and inner casings are provided with means to prevent their rotation during the operation of the apparatus, while means are provided on the outer end of the shaft to rotate the intermediate casing 6 to which a boring head 17 is attached. The boring head 17 is provided with a plurality of earth boring bits 18 fixed to the outer end of the intermediate circular casing and is adapted to cut a cylindrical path at the bottom of the drilled hole when the intermediate casing is rotated leaving a solid uncut circular center portion intact, as shown at 20 in FIG. 1C, and may be later referred to as a core.

While the shaft 22 is used to rotate the intermediate casing, it is also used to supply a fluid lubricant under pressure to the apparatus and particularly to the cutter head 17. The lubricant may be in any suitable form such as water, air, drill fluid, etc.

The hollow shaft is normally supplied in sections, the number of sections depending upon the depth of the hole. The ends of the sections are threaded into each other to whatever length is necessary for the operation.

The outer end of the rotatable shaft 22 is threadably attached to a hollow outer spindle 24 as shown at 22' and 24'. The spindle 24 in turn telescopes an inner hollow spindle 23 and is slideably engagable therewith along their longitudinal axes and are connected for rotation by means of splines 27, wherein the inner spindle 23 is directly connected to the gear train for rotating the intermediate casing 6.

The slideable engagement of the spindle 24 with the spindle 23 is limited by the shoulder 25 carried on the spindle 24 and the shoulder 21 carried on an assembly 28 enclosed within the outer casing 2.

Positioned on the outer end of the spindle 24 is a portion of a gate valve 29 adapted to cooperate with a second portion 29' positioned on the inner end of the spindle 23 for closing the opening leading from the outer spindle 24 into the hollow inner spindle 23. When the spindle 24 is moved upwardly bringing the shoulders 21 and 25 into engagement the valve portions 29 and 29' will become engaged thus closing the hollow passage between the two spindles 24 and 23.

Figure 1B:
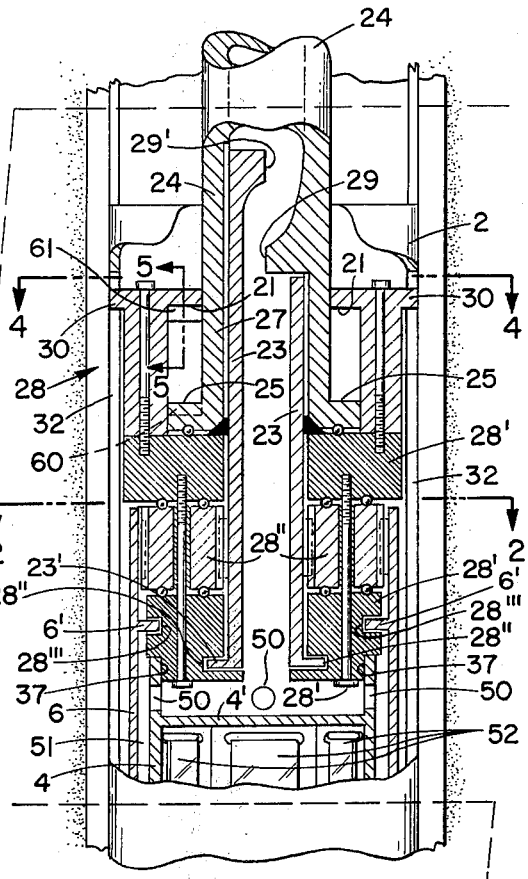
FIG. 1B is a sectional view of the intermediate portion of the apparatus, and is a continuation of FIG. 1A.
Figure 4:
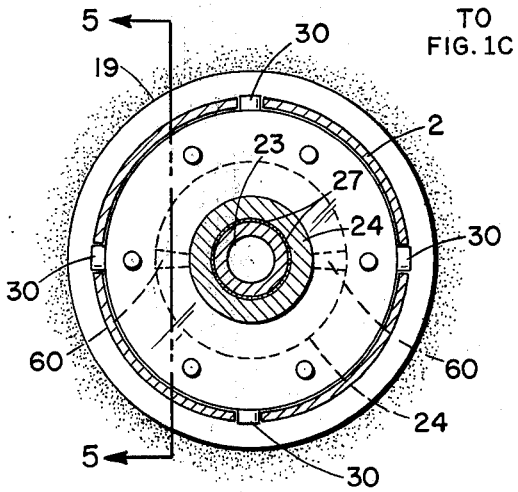
FIG. 4 is a sectional view taken on line 4—4 of FIG. 1B.
Figure 5:
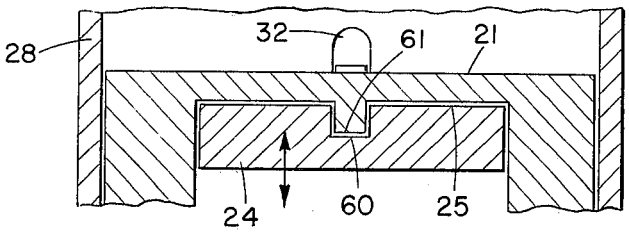
FIG. 5 is a fragmentary enlarged vertical sectional view taken on the line 5—5 of FIG. 1B.
Figure 1C:
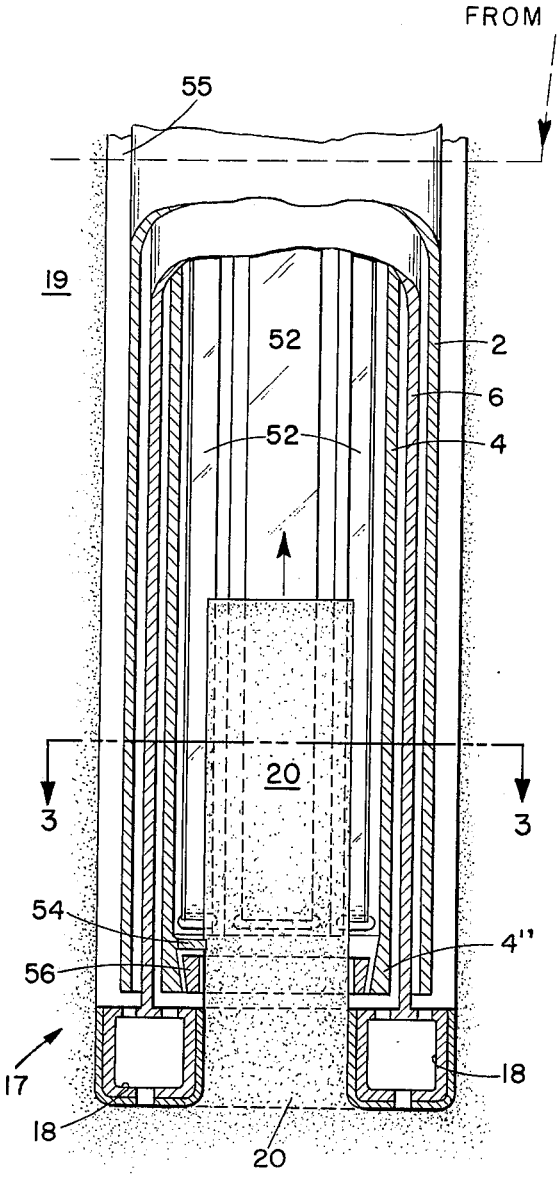
FIG. 1C is a sectional view of the outer end portion of the apparatus, and is a continuation of FIG. 1B.
Figure 2:
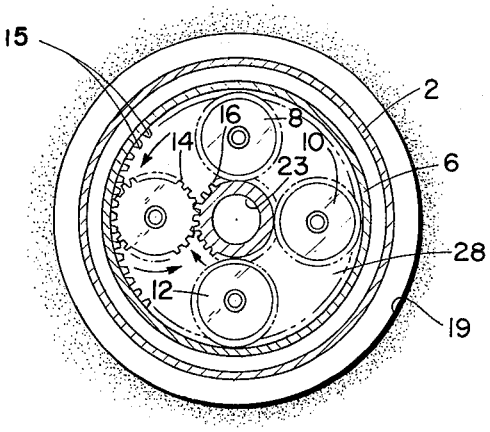
FIG. 2 is a sectional view taken on line 2—2 of FIG. 1B.
Figure 3:
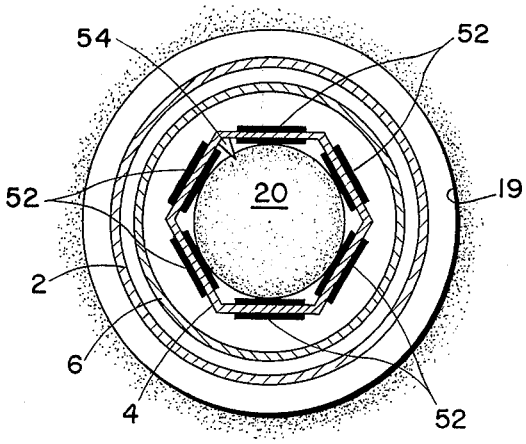
FIG. 3 is a sectional view taken on line 3—3 of FIG. 1C.

The inner spindle 23 and the gear train are bearinged on the assembly 28, which is of such size as to be slideably encased within the casing 2 as shown in FIGS. 1B and 2.

The inner spindle 23 is prevented from axial movement relative to the assembly 28 by a flange 23' operated within a groove 28'' formed within the member 28' of the assembly 28.

The gear train is shown in the form of a planetary gear and comprises a gear 16 fixedly secured to the inner spindle 23, which engages four other gears, 8, 10, 12 and 14, which in turn are geared to the intermediate casing 6 by means of a ring gear 15, as shown in FIG. 2; however, any suitable reduction gear may be used. The gears 8, 10, 12 and 14 are rotatably mounted on the assembly 28 as shown best in FIGS. 1B and 2. To retain the intermediate rotatable casing 6 in its relative position within the assembly 28 there is provided a flange 6' fixedly secured to the intermediate casing 6 which is adapted to rotate within a groove 28''' formed in the assembly member 28'.

The assembly 28 is slideably retained within the casing 2 by the lugs 30 which may be arranged in any suitable number and manner. These lugs 30 are a part of, or separate elements fixed to the assembly 28 and extend through elongated vertical slots 32 which are of predetermined length in the outer casing 2 to cut a core of suitable length. The slots 32 extend normally substantially the full length of the casing 2, which allows for substantial longitudinal movement of the assembly 28 relative to the casing 2.

Immediately above or inward of the assembly 28 and within the inner end of outer casing 2 is a second assembly 33. This second assembly is positioned about the spindle 24. The spindle 24 is provided with an opening 48 adjacent the area 49 of the second assembly, whose function will be later referred to.

The assembly 33 is provided with a pair of slideable pistons 34 and 36. These pistons are connected by a tension spring 38 for normally holding the pistons in contact with the stops 31'' and 31''' which are fixed to the inner surface of the casing 2. The pistons are adapted to slide freely within the casing 2 and on the spindle 24 with suitable packing to prevent leakage between the casing 2 and the spindle 24. The object of these pistons is to operate a number of anchor arms such as those shown at 40 and 42. These pistons are moved to their outward position in contact with the stops 31 and 31', which are also fixed to the inner surface of the outer casing 2, by fluid pressure received through the hollow shaft 22 and spindle 24. The arms 40 and 42, when extended, are adapted to engage the sidewalls of the bored hole 19 to hold the outer casing 2 against rotation when the intermediate casing is rotated.

The arms 40 are extended by the movement of the piston 34 and the arms 42 are extended by the movement of the piston 36. The arms 40 are hingedly pinned to the casing 2 by the pins 41 and are connected to the piston 34 by the link members 44. The anchor arms 42 are hingedly pinned to the casing 2 by the pins 43 and are connected to the piston 36 by the link member 46, the arms 40 and 42 operating through suitable slots 2' and 2'' formed in the outer casing 2. It will be seen that when the pistons are extended, as shown in full lines in FIGS. 1A, the arms are extended to engage the sidewall of the hole 19.

The opening 48 in the spindle 24 is so positioned on the spindle that when the spindle is in its uppermost position and the two shoulders 21 and 25 are in contact, the opening 48 in the spindle 24 will be moved into the area 49 between the pistons 34 and 36, and when the shoulders are returned to their lowermost position, as shown in FIG. 1A, the opening 48 in the spindle 24 will be outside the area 49 and just below the piston 36.

When no pressure is present within the area 49, the tension spring 38 will hold the pistons 34 and 36 in contact with stops 31'' and 31''' which through the previously mentioned linkage will position the anchor arms 40 and 42 parallel with the wall of the outer casing 2, which releases the casing 2 from the bored hole 19.

Referring again to the inner casing 4, there is also provided on the outer end of the casing 4 a marking element 54 extending inwardly of the casing to engage the outer surface of the core 20 to form a mark thereon as the core 20 is moved up on the inside of the casing. This mark 54 is to designate the azimuth of the core in relation to the earth from which it was removed.

The casing 4 has one end attached to the outer end of the assembly 28, as shown at 37 in FIG. 1B. The casing is also provided with a head member 4' adjacent the attached end thereof to prevent the drill fluid lubricant from entering the top of the inner casing when the apparatus is in operation. Immediately above the head member 4' are a plurality of fluid outlet ports 50 to allow the drill fluid received from the inner spindle 23 to flow into the opening 51 between the casing 4 and the intermediate casing 6 to lubricate the cutting bits 18 and to flush the cuttings out of the bored hole 19.

The casing 4 is further provided with a plurality of smooth free-floating belts 52, previously made of teflon or a belting material having a teflon facing, for decreasing the friction between the sides of the casing and the core as the core moves up into the casing.

As this non-rotating inner casing 4 moves downwardly with the rotating intermediate casing 6, carrying the boring bits 18, a ring-like hole is bored at the bottom of the original hole 19 leaving a solid center portion which moves up into the inner casing 4.

The inner casing 4 is still further provided with a tapered outer end 4'' above which is a free-floating tapered split ring 56 which is adapted to engage the lower end of the core when the core is lifted from the bottom of the bored hole 19.

In order to correctly mark the core as it is being received into the inner casing, the position of the marker 54 must be known when the apparatus comes to rest at the bottom of the bored hole 19. This is done by placing a scribed mark 53 on the shaft 22, part of which is always above ground level, and bringing this line 53 in line with the marker 54 carried on the casing 4. As the outer casing 2, the inner casing 4 and the assembly 28 are all tied to each other as non-rotating members, the core marker 54, carried by the casing 4, is known in relation to the assembly 28 at the time the anchors 40 and 42 are expanded. In order to bring the mark 53 on the shaft 22 and the marker 54, carried on the inner casing 4, in line there is provided a recess 60 formed on the shoulder 25 of the spindle 24 which is in line with the mark 53 carried by the shaft 22, and a lug 61, formed on the shoulder 21 of the assembly 28, which is always in line with the marker 54 carried by the inner casing 4. By bringing the recess 60 and the lug 61 in alignment, the mark 53, carried by the shaft 22 is aligned with the marker 54, carried by the inner casing 4.

When it is desired to obtain a sample core from the bottom of drilled hole 19, at least one section of shaft 22 is connected to the spindle 24 as shown at 22' and 24', in FIG. 1A, which in turn is rotatably supported on the assembly 28. When the apparatus is suspended on the shaft 22, the weight of the apparatus will cause the shoulder 25, carried by the spindle 24, to move upwardly and contact the shoulder 21, carried by the assembly 28. If not already engaged, the apparatus or the shaft 22, or both, are rotated until the recess 60 and the lug 61 become engaged bringing the marker 54, carried by the inner casing 4, in line with the mark 53, carried by the shaft 22, whereby the marker 54 may be oriented by further rotation of the shaft 22, after which the suspended apparatus is lowered into the drilled hole 19 by the shaft 22.

When the spindle 24 is in its upward position as just described, the valve parts 29 and 29' will become engaged to prevent fluid from passing into the inner spindle 23.

Up to this point the shaft 22 is not rotated, nor is any fluid supplied to the hollow shaft 22, nor will any fluid be supplied to the shaft 22 until the apparatus is secured at the bottom of the bored hole 19.

To secure the apparatus in place after it has reached the bottom of the hole 19, the shoulders 21 and 25, if not already in engagement, are brought together by lifting the shaft 22 and spindle 24. In this position the opening 48 is located within the area 49 between the pistons 34 and 36. At this point a fluid under pressure is supplied to the hollow shaft 22, which in turn moves into the hollow spindle 24. As the valve parts 29 and 29' are closed, the fluid moves through the opening 48 into the area 49, expanding the pistons 34 and 36 to a point where they are in engagement with the stop member 31 and 31'. This movement of the pistons will cause the arms 40 and 42 to move laterally outwardly and engage the side walls of the bored hole 19 to secure the outer casing 2 in a fixed location within the bored hole 19.

After the casing 2 has been secured in position, as previously described, and the azimuth noted, the hollow shaft 22 is again moved downwardly the distance between the two shoulders 21 and 25 disengaging the recess 60 and lug 61. This movement also moves the opening 48 in the spindle 24 out of the area 49 from between the two pistons, trapping the fluid which is under pressure within the area 49 which holds the arms 40 and 42 in engagement with the bored hole wall 19 and at the same time the downward movement of the spindle 24 will separate the valve members 29 and 29' to allow the fluid to move through the inner spindle 23 and through the openings 50 in the inner casing 4 to the space 51 between the inner casing 4 and the rotatable intermediate casing 6 to the cutter bits 18 for lubricating the cutter bits and flushing the cuttings from around the apparatus and out the top of the bored hole, while the intermediate casing is being rotated by the shaft 22 through a gear train shown at 8, 10, 12, 14 and 16 in FIG. 2.

When a sufficient length core has been cut and deposited in the inner casing 4, the shaft 22 is again raised wherein the shoulders 21 and 25 are brought into engagement again, moving the opening 48 into the area 49 between the piston members 34 and 36. This time no pressure is applied to the fluid in the hollow spindle 24 or the fluid in area 49 which is already under pressure. This allows the fluid within the area 49 to enter the opening 48 and drain back into the hollow spindle 24. By relieving the pressure in the area 49 between the pistons 34 and 36 the tension spring 38 will bring the pistons 34 and 36 together to a point where they will be in contact with the extensions 31'' and 31''' carried on the inner surface of casing 2. This action of the spring 38 on the pistons will withdraw the arms 40 and 42 from the side wall of the bored hole 19 as previously described.

The apparatus may now be lifted from the bored hole 19 by the shaft 22. At the beginning of the lift, the weight of the core in the inner casing 4 will cause the ring 56 to engage the tapered end 4'' of the casing 4 to further close the ring to break the core loose from the bottom of the cut and retain the core within the casing 4 during its removal with the apparatus from the bored hole.

When the apparatus is moved to ground level the core, with its azimuth mark along the side thereof, is removed from the inner casing to be used for whatever purpose it was obtained.

While a specific form of the apparatus has been shown and described, it is not intended as a limitation as the scope of the invention is best defined in the appended claims.

I claim:

1. A core collecting apparatus for obtaining and retrieving samples of earth from the bottom of a previously earth-drilled hole, comprising:

a. a plurality of telescoped circular casings comprising an outer and inner casing and an intermediate casing;

b. an assembly positioned within the outer casing for supporting the intermediate and inner casings, means for restricting rotation of the assembly relative to the outer casing, and means affording limited axial movement of the assembly relative to the outer casing;

c. a plurality of earth boring bits positioned on the outer end of the intermediate casing adapted to cut a circular downward path through the earth at the bottom of the said hole when the intermediate casing is rotated leaving a center core portion extending upwardly into the inner casing;

d. a rotatable hollow shaft adapted to extend into the previously bored hole for rotating the intermediate casing and for supplying a drill fluid to the apparatus;

e. means for anchoring the outer casing to the side wall of the bored hole;

f. means for retaining the core within the inner casing as the apparatus is being withdrawn from the bored hole.

2. In a core collecting apparatus as claimed in claim 1 wherein means are provided along the inside surface of the inner casing for reducing friction between the outer surface of the core and the inner surface of the inner casing.

3. In a core collecting apparatus as claimed in claim 1 wherein means are provided to align the hollow drill shaft with the inner casing.

4. In a core collecting apparatus as claimed in claim 1 further comprising a valve through which drill fluid passes to the cutter bits and wherein means are provided for moving the said shaft axially for said predetermined distance relative to the assembly for closing and opening a valve.

5. In a core collecting apparatus as claimed in claim 1 wherein a marking element is carried by the inner casing for placing a mark on the side of the core as it is received into the inner casing and means for aligning the marking element with a scribed mark carried by the hollow shaft to ascertain the azimuth of the core.

6. In a core collecting apparatus as claimed in claim 1 further comprising a marking element carried by said apparatus for marking said core, wherein an orientation scribed mark is placed on the shaft parallel with its elongated axis and means carried by the apparatus for aligning said scribed mark with said marking element.

7. In a core collecting apparatus as claimed in claim 1 wherein the anchoring means for anchoring the outer casing to the bored hole comprises a plurality of laterally extendable arms.

8. In a core collecting apparatus as claimed in claim 7 comprising means for laterally extending the arms including a piston means adapted to be operated by the drill fluid.

9. In a core collecting apparatus as claimed in claim 1 wherein one end of the hollow shaft is bearinged in the said assembly, and a gear train for transmitting rotation from the hollow shaft to the intermediate casing.

10. In a core collecting apparatus as claimed in claim 4 wherein the gear train is in the form of planetary gearing.

* * * * *